US006801746B2

(12) United States Patent
Mills

(10) Patent No.: US 6,801,746 B2
(45) Date of Patent: Oct. 5, 2004

(54) METHOD AND SYSTEM FOR REDUCING TONER RUB-OFF IN AN ELECTROPHOTOGRAPHIC APPARATUS BY USING PRINTERS' ANTI-OFFSET SPRAY POWDER

(75) Inventor: Borden H. Mills, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 8 days.

(21) Appl. No.: 10/180,755

(22) Filed: Jun. 26, 2002

(65) Prior Publication Data

US 2003/0031484 A1 Feb. 13, 2003

Related U.S. Application Data

(60) Provisional application No. 60/310,872, filed on Aug. 8, 2001.

(51) Int. Cl.[7] ..... G03G 15/00; G03G 15/20; G03G 21/00; B41F 35/00; B41L 41/00

(52) U.S. Cl. ..... 399/341; 101/424.2; 399/324; 399/407

(58) Field of Search ..... 399/324, 341, 399/407; 101/424.2

(56) References Cited

U.S. PATENT DOCUMENTS 3,653,932 A 4/1972 Berry et al.
3,715,219 A 2/1973 Kurz et al.
3,984,809 A 10/1976 Dertouzos et al.
4,000,957 A * 1/1977 Ruhland ..... 399/324
4,250,511 A 2/1981 Stein et al.
4,390,369 A 6/1983 Merritt et al.
4,447,818 A 5/1984 Kurata et al.
4,458,253 A 7/1984 Goff, Jr. et al.
4,484,948 A 11/1984 Merritt et al.
4,490,731 A 12/1984 Vaught
4,568,949 A 2/1986 Muranaka
4,659,383 A 4/1987 Lin et al.
4,666,757 A 5/1987 Helinski
4,721,635 A 1/1988 Helinski
4,745,420 A 5/1988 Gerstenmaier
4,836,129 A * 6/1989 Dahlgren ..... 101/424.2 X
4,851,045 A 7/1989 Taniguchi
4,869,921 A * 9/1989 Gabel et al. ..... 101/424.2 X
4,889,560 A 12/1989 Jaeger et al.
4,908,669 A * 3/1990 Yamamoto ..... 399/341 X
5,006,170 A 4/1991 Schwarz et al.
5,092,235 A 3/1992 Rise
5,151,120 A 9/1992 You et al.

(List continued on next page.)

*Primary Examiner*—Fred L. Braun

(57) ABSTRACT

Apparatus and method for reducing toner rub-off from a copy made by an electrophotographic process wherein printers' anti-offset powder (e.g. finely-powdered starch) is sprayed onto the copy after the toner image has been fused to the copy. If a release oil is present on the copy, the powder is sprayed directly onto the release oil on the copy. To apply the powder, an applicator is positioned within the finishing section of the electrophotographic apparatus and sprays the copy with the powder as the copy exits the fuser section of the apparatus.

6 Claims, 1 Drawing Sheet

U.S. PATENT DOCUMENTS 5,182,572 A 1/1993 Merritt et al.
5,185,035 A 2/1993 Brown et al.
5,213,271 A * 5/1993 Uribe et al. ..... 239/654
5,265,536 A * 11/1993 Millard ..... 101/424.2
5,372,852 A 12/1994 Titterington et al.
5,389,958 A 2/1995 Bui et al.
5,495,270 A 2/1996 Burr et al.
5,541,624 A 7/1996 Cooke et al.
5,569,540 A 10/1996 Hirose et al.
5,598,195 A 1/1997 Okamoto et al.
5,672,413 A 9/1997 Taylor et al.
5,827,918 A 10/1998 Titterington et al.
5,830,942 A 11/1998 King et al.
5,835,833 A * 11/1998 Dalal et al. ..... 399/324 X
5,879,790 A 3/1999 Sogabe et al.
5,922,114 A 7/1999 Sawada
5,954,865 A 9/1999 Sawada
5,958,169 A 9/1999 Titterington et al.
5,964,155 A * 10/1999 Platsch ..... 101/424.2
5,966,150 A 10/1999 Lester et al.
5,980,621 A 11/1999 Inaishi et al.
5,987,301 A * 11/1999 Acquaviva ..... 399/341 X
5,994,453 A 11/1999 Banning et al.
6,015,847 A 1/2000 Titterington et al.
6,018,005 A 1/2000 Banning et al.
6,022,910 A 2/2000 Nishizaki et al.
6,028,138 A 2/2000 Hahn et al.
6,037,396 A 3/2000 Sawada
6,038,998 A * 3/2000 Platsch ..... 101/424.2 X
6,048,925 A 4/2000 Titterington et al.
6,057,385 A 5/2000 Syutara et al.
6,063,729 A 5/2000 Eguchi et al.

* cited by examiner

METHOD AND SYSTEM FOR REDUCING TONER RUB-OFF IN AN ELECTROPHOTOGRAPHIC APPARATUS BY USING PRINTERS' ANTI-OFFSET SPRAY POWDER

RELATED APPLICATIONS

This application is entitled to and hereby claims the benefit of the filing date of U.S. Provisional application No. 60/310,872 filed on Aug. 8, 2001.

FIELD OF THE INVENTION

The present invention relates to reducing toner rub-off in an electrophotographic apparatus and in one of its aspects relates to a method and a system for reducing toner rub-off in copies produced in an electrophotographic apparatus by spraying printers' anti-offset powder onto the copies after they pass through the fuser section of the apparatus but before they are stacked or otherwise finished.

BACKGROUND OF THE INVENTION

In a typical electrophotographic apparatus (e.g. copier), a continuous loop of photoconductor film or the like is commonly used to transfer an image from an input section onto a receiving medium (e.g. a sheet of paper or the like). The film is charged and passed through an input section where an image (i.e. analog or digital) is projected onto the charged film. The film then moves through a developing section where toner is applied to the charged image before the image is transferred to the sheet of paper. The paper is subsequently passed through a fuser section where the toner is typically fixed to the paper by passing the paper between two rollers, i.e. a pressure roller and a fuser roller, at least one of which is heated. Heat can be applied to either the inside or outside of the heated roller. One of the rollers typically has a compliant surface which deflects to form a fusing "nip" when the two rollers are pressed together.

A known problem in fuser sections of this type is one which is commonly referred to as "offset". Offset occurs when some of the heat-softened toner particles remain on the fuser roller and are not fixed onto the paper as desired. As well understood in the art, this offset can severely affect the quality of the copies being made by the machine. To alleviate this problem, a release oil, e.g. silicone oil plus additives, is typically applied onto the fuser roller to prevent the toner from sticking thereto. Some of this release oil may also come off onto both the image and the blank areas of a copy as the copy passes through the nip between the rollers.

Also, since the toner used in these types of electrophotographic apparatus is only partially melted, the toner does not soak into the copy substrate as most inks do, even when the substrate is as absorbent as bond paper. Instead the toner forms a localized, raised portion in the image area on the copy substrate. If the desired image finish is very low in gloss, the image surface is also likely to be rough in order to scatter light.

Since the images on the copy substrate are raised and sometimes rough, they can be easily abraded or "rubbed off" during any one of several finishing processes which may be carried out in the finisher or finishing section of an electrophotographic apparatus after the copy has passed through the fuser section. These finishing processes may include one or more of the following: re-imaging (double-sided copying), folding, stapling, binding, collating, stacking, etc. Residue from this abrasion can cause objectionable marks on adjacent copies or covers which, in turn, can produce copies of unacceptable quality. This abrasion and associated defect is known in the art as "rub-off". Since all that is needed to generate rub-off is a donor (toner image), a receptor, differential velocity between the donor and receptor, and load between the donor and receptor, rub-off is common, in varying degrees, in most, if not all, electrophotographic copiers of this type.

Basically speaking, the mechanisms of rub-off are consistent with those found in abrasive and adhesive wear. Accordingly, several of the factors that influence abrasive and/or adhesive wear also influence toner rub-off. Such factors include (a) toughness of the toner; (b) the coefficient of friction of the toner; (c) how well the toner is attached to the substrate and to itself; (d) the coefficient of friction and surface topography of the toner image; (e) the level of load and relative velocity of the wearing surfaces; and (f) the characteristics of the wearing surfaces.

More specifically, (1) tougher toner with a lower coefficient of friction, (2) a toner that fuses better or is fused better, (3) a smoother image finish, and/or (4) a lower coefficient of friction of the finished image will all reduce toner rub-off. Unfortunately, however, there are certain drawbacks associated with each of these factors. For example, a tougher toner is not only more expensive to grind, it is also more difficult to grind and maintain the extremely small particle sizes that are most desirable for such toners.

Further, when the coefficient of friction of the toner is reduced by adding wax, the charging behavior of the toner may become inconsistent leading to copies of differing quality. Still further, toner that fuses better is more likely to fuse in certain subsystems of the copier apparatus (e.g. developer and cleaning stations) where it should not fuse causing obvious problems. Also, using better-fusing toner and/or increasing heat on the fusing roller can cause more toner to stick to the fuser roller and/or increase the tendency of fused copies to stick to each other in the finisher or output trays. Likewise, providing a smoother toner image surface can increase image gloss to an unacceptable level while increasing the use of fuser release oil can cause undesirable effects in the rest of the electrophotographic process, especially when the copy is recycled in a two-sided copying process.

Some of the above mentioned factors are under the control of the apparatus and material manufacturers while others are under the control of the customer/end user. In any event, it should be readily recognized and appreciated by those familiar with this art that any reduction in toner rub-off which can be achieved with a minimum of expense and/or sacrifice to the operation and maintenance of the copier will be highly beneficial to all concerned.

SUMMARY OF THE INVENTION

The present invention provides a method and apparatus for reducing toner rub-off from a copy made by an electrophotographic process. Basically printers' anti-offset powder (e.g. finely-powdered starch) is applied onto the copy after the copy has passed through the fuser section and the image has been fused to the copy. The powder may be sprayed onto either or both sides of the copy.

Typically, a release oil is applied to the fuser roller within the fuser section of a electrophotographic copier to aid in preventing toner from sticking to the fuser roller. As will be understood, some of this release oil will inherently be transferred to the copy as the copy passes over the fuser roller. Where release oil is present on the copy, the printers' anti-offset powder is sprayed directly over said fuser release oil on said copy and will stick thereto.

To apply the printers' anti-offset powder in the present invention, an applicator is positioned downstream of the fuser section (e.g. in the finishing section of the electrophotographic apparatus) which receives the copy after the copy has passed through the fuser section and a toner image has been fused onto the copy. As illustrated, the applicator is comprised of a container which is adapted to be positioned within the finishing section of the copier. The container is adapted to store a quantity of the printers' anti-offset powder. An air supply conduit, which is connected to an air supply at one end and closed at the other, passes through the container. The outer portion of the air supply conduit, having at least one exit therein, is configured so that it will be positioned substantially parallel to a copy as the copy passes from the fuser section and through the finishing section of the electrophotographic copier apparatus.

The air supply conduit has an inlet which is positioned within said container and provides an opening through which powder can be drawn into the air stream which is flowing through the conduit. The air supply also has an outlet positioned within the container and upstream from the inlet to supply air into said container under pressure to aerate and thereby suspend a portion of the powder within said container.

The air passing through the air supply conduit draws the suspended powder into the conduit through the inlet. The air stream then carries the suspended powder through the conduit to the outer portion thereof. The suspended powder then passes through exit(s) spaced along the length of the outer portion of the conduit and is sprayed directly onto the copy as the copy moves past the air supply conduit.

BRIEF DESCRIPTION OF THE DRAWINGS

The actual construction operation, and apparent advantages of the present invention will be better understood by referring to the drawings, not necessarily to scale, in which like numerals identify like parts and in which.

While the invention will be described in connection with its preferred embodiments, it will be understood that this invention is not limited thereto. On the contrary, the invention is intended to cover all alternatives, modifications, and equivalents which may be included within the spirit and scope of the invention, as defined by the appended claims.

DESCRIPTION OF THE PREFERRED EMBODIMENTS

Figure 1:
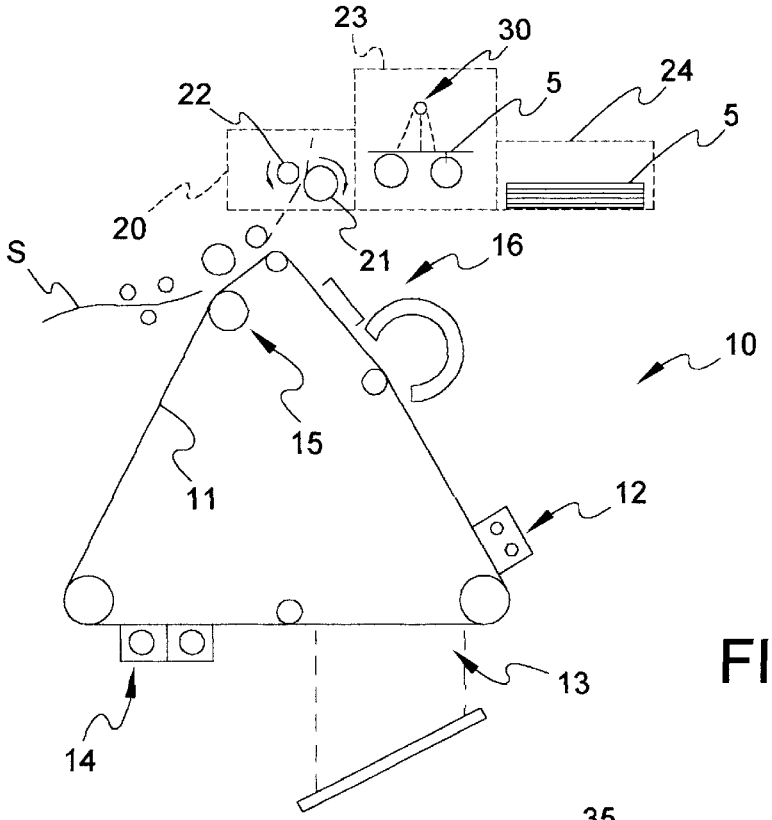
FIG. 1 is a schematic view of an electrophotographic copier apparatus in which the present invention is incorporated.

Referring to the drawings, FIG. 1 schematically illustrates a typical electrophotographic apparatus or machine 10 (e.g. copier) of the kind that has an endless photoconductor member 11 (e.g. photographic film) which moves through a closed loop past a charging station 12, an exposure or input station 13, a developing station 14, a transfer station 15, and a cleaning section 16. A copy substrate or medium (e.g. a sheet S of paper) is fed from a supply (not shown) through transfer station 15 where the toner image on the film 11 is transferred onto the paper S. The toner image is then fused onto the sheet S by applying heat and/or pressure thereto. For example, the paper S is typically fed between two rollers, e.g. a heated, fuser roller 21 and a pressure roller 22 in fuser section 20 to fix the toner image on the paper S.

As will be understood in the art, in fuser sections of this type, some of the toner particles are likely to adhere to fuser roller 21 (i.e. "toner offset") which can severely affect the quality of the copies being made. To alleviate this problem, a "release" oil (e.g. silicone oil) is applied directly onto fuser roller 21 by means of a wick roller or the like (not shown). This oil prevents toner from sticking to the fuser roller. For a more detailed disclosure of a wick roller and its operation, see co-pending and commonly assigned U.S. patent application Ser. No. 09/745,861, filed Dec. 21, 2000, now U.S. Pat. No. 6,430,385, and incorporated herein by reference. While some of the release oil will inherently transfer from fuser roller 21 to the sheet S as the sheet passes through the nip between the fusing rollers and will remain thereon for a period of time after fusing, the amount of oil is normally undetectable to the naked eye and in no way interferes with the quality of the copies.

Sheet S passes from fuser section 20 and into finisher or finishing section 23 of copier apparatus 10. As used herein, "finisher" and "finishing section" is intended to mean any section which lies downstream from the fusing section. That is, the sheets may pass directly through finishing section 23 and into a tray 24 where they are stacked, one on top of the other, or the sheets S may undergo an additional finishing operation (e.g. re-imaging, stapling, collating, folding, mail-sorting, etc.) (none shown) within finishing section 23 before they finally exit into tray(s) 24 or like handling. As will be understood in the art, when the sheets S are stacked or otherwise finished, the bottom of one sheet (i.e. receptor) will move or rub across the top of an adjacent sheet (i.e. donor) at a differential velocity. It is during this time that "rub-off" normally occurs.

In accordance with the present invention, the magnitude of toner rub-off is substantially reduced by applying printers' anti-offset or set-off spray powder onto either or both sides of a copy after it exits the fuser section. The powder may be sprayed directly onto the back of a sheet (FIG. 1) or it may be sprayed directly onto the fused image on the sheet S after the sheet exits the fuser section 20 and before it undergoes further processing within the finishing section 23 of copier apparatus 10. The anti-offset powder used in the present invention may be any of the powders (e.g. starch) which are commonly used in certain ink printing processes wherein a dry spray of the finely-grained powder is applied to freshly printed copies to prevent the wet ink from transferring from the top of one sheet to the bottom of the adjacent sheet.

More specifically, an applicator or dispensing system 30 is positioned in the finishing section 23 of copier 10 adjacent or near the outlet of the fuser section 20. While the applicator 30 may take different forms, as illustrated in FIG. 2, its construction is similar to that of those typically used in the ink printing industry to apply printers' offset powder to freshly printed copies to keep wet ink from smearing as one copy is stacked onto an adjacent copy.

Figure 2:
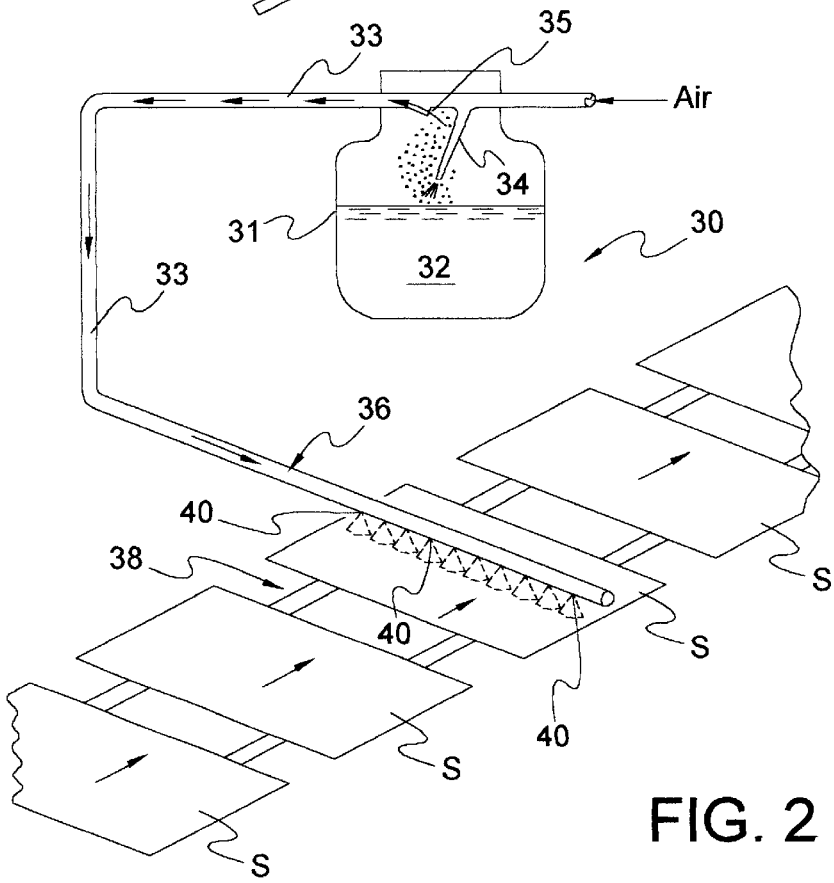
FIG. 2 is a simplified, perspective view of an applicator which is used to apply printers' anti-offset powder to a copy to reduce toner rub-off in the apparatus of FIG. 1 in accordance with the present invention.

As shown in FIG. 2, applicator 30 is comprised of a container 31 which is adapted to receive and store a quantity of a printers' anti-offset spray powder 32. As mentioned above, powder 32 may be selected from the type of finely-grained, powders commonly used in the ink printing industry to prevent undried ink from smearing. Preferably, this powder is a finely-grained, commercially-available starch (e.g. corn starch used in food products).

An air-supply conduit 33 passes through the upper portion of container 31 and is adapted to be connected at one end to a compressed air source (not shown) and is closed at the other end. Conduit 33 has an outlet tube 34, positioned within container 31, which extends downwardly into the container as shown in FIG. 2 for a purpose to be described below. Conduit 33 also has an inlet 35 positioned within container 31 which is formed by an angled opening in the conduit just downstream of outlet 34. The outer portion 36 of conduit 33 is configured so that it will be positioned substantially parallel to sheets S as they pass through finishing section 23 on a transport (e.g. endless belt 38 or the like). Outer portion 36 has a plurality of exit openings 40 (only some numbered for clarity) spaced along the length thereof.

As illustrated in FIG. 2, the exit openings 40 open downwardly towards the back side of sheets S. That is, when the sheet passes through fuser section 20, the toner image will lie on the front of sheet S. While applying powder to the back side of the copy aids in reducing toner rub-off, there are instances where it may be preferred to spray the powder directly onto the front side containing the toner image. This is easily accomplished by (1) re-positioning tube 33 below sheet S in FIG. 1 and directing exits 40 upward toward the front side of the copy or (2) passing the sheet through an inverter before passing the copy under applicator 30 or (3) spraying both sides simultaneouly by providing duplicate tubes 33, one over and one under a sheet S.

In operation, a sheet S of paper or the like is fed from a supply (not shown) through transfer station 15 where the toner image on the film 11 is transferred onto the paper S. The paper S is then fed between a heated fuser roller 21 and a pressure roller 22 in fuser section 20 to fix the toner image on the paper S. In some instances, the sheet S then passes into finishing section 23 where, in accordance with the present invention, it moves past the outer portion of conduit 36.

As sheets S pass under outside portion 36 of conduit 33, air is being supplied through conduit 33. As the air in conduit 33 passes through container 31, a portion of the air is diverted through outlet tube 34 to aerate the printers' anti-offset powder 32 (e.g. finely granulated starch) in the container, which in turn, causes some of the powder to become suspended therein. The remainder of the air passes over inlet 35 and on through conduit 33 at a relatively high pressure. As will be understood, in accordance with Bernoulli's principle, this, in effect, reduces the pressure within the tube at inlet 35 which, in turn, draws the suspended particles of powder 32 through inlet 35 and into the air stream flowing through conduit 33. The air carries the powder through conduit 33 and out exits 40 onto a sheet S as the sheet passes through the finishing section 23.

When the anti-offset powder 32 is brought into contact with a recently fused image on a sheet S, it has a tendency to stick to any of the high viscosity, fuser release oil which may have been transferred to the sheet in the fuser section 20 as described above. This significantly reduces the rub-off between the sheets S as they are finished and/or stacked in the finishing section of electrophotographic apparatus 10. Further, in some cases, the anti-offset powder 32 can be applied to sheets S as they are stacked without relying on the powder sticking to the fuser release oil, if none is present. Still further, as described above, the powder can be applied to either or both sides of each sheet S depending on the finishing process being carried out by the copier.

In an abbreviated test of the present invention, an un-weighed amount of commercially available ARGO corn starch was sprinkled onto the imaged side of a portion of copies formed by a electrophotographic process using a roller fuser and release oil. Treated and untreated copies were then rubbed together using a standard "rub-off" process. The severity of toner rub-off of the sample copies treated with the corn starch was only 19% of the rub-off of the untreated sample copies, proving that application of the powdered starch can significantly reduce toner rub-off.

What is claimed is:

1. A method for reducing toner rub-off from a copy made by an electrophotographic process, and comprising a substrate bearing a toner image on a first image-bearing side and having a second non-image-bearing side, said method comprising:

applying toner to said substrate to form said toner image on said first image-bearing side;

applying heat and/or pressure to said copy to fuse said toner image to said first image-bearing side of said substrate; and applying printers' anti-offset powder to said copy after said toner image has been fused to said second non-image-bearing side of said substrate to thereby reduce toner rub-off from said copy.

2. The method of claim 1 wherein said printer's anti-offset powder is finely-powdered starch.

3. The method of claim 2 wherein said finely powdered starch is cornstarch.

4. The method of claim 1 wherein said printers' anti-offset powder is sprayed onto said copy.

5. An electrophotographic apparatus having a finishing section for receiving a copy after a toner image has been fused thereon, said finishing section including an applicator for applying printers' anti-offset powder to said toner image on said copy after said copy enters said finishing section:

a container adapted to store a quantity of said printers' anti-offset powder said printers' anti-offset powder comprising finely powdered starch; and an air supply conduit passing through said container, said conduit being adapted to be connected to an air supply at one end and closed at the other end;

an inlet in said air supply conduit positioned within said container for receiving said powder into said conduit;

said air supply conduit having an outer portion of its length adapted to lie substantially parallel to said copy as said copy passes through said finishing section; and at least one exit in said outer portion of said air supply conduit positioned to open towards said copy through which said printers' anti-offset powder will be sprayed onto said copy from said air supply conduit.

6. The electrophotographic apparatus of claim 5 including:

an outlet in said air supply conduit positioned within said container and upstream from said inlet to thereby supply air into said container to aerate said printers' anti-offset powder within said container.

* * * * *